US007837347B2

(12) United States Patent
Warner et al.

(10) Patent No.: US 7,837,347 B2
(45) Date of Patent: Nov. 23, 2010

(54) REVERSIBLE LIGHT REFLECTOR

(75) Inventors: Christopher P. Warner, Hamilton, AL (US); William Thomas Busch, Tupelo, MS (US); Charles Adrian Phillips, Sr., Starkville, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 366 days.

(21) Appl. No.: 11/763,957

(22) Filed: Jun. 15, 2007

(65) Prior Publication Data

US 2007/0291495 A1 Dec. 20, 2007

Related U.S. Application Data

(60) Provisional application No. 60/805,029, filed on Jun. 16, 2006.

(51) Int. Cl.
*F21V 1/00* (2006.01)

(52) U.S. Cl. ..... 362/217.03; 362/248; 362/281

(58) Field of Classification Search .....
362/217.01–217.09, 247, 248, 260, 276, 362/277, 279, 280, 281, 290, 310, 319, 325, 362/326, 327, 328, 341, 342, 350, 354
See application file for complete search history.

(56) References Cited

U.S. PATENT DOCUMENTS 2,337,745 A * 12/1943 Garstang ..... 362/260
4,598,344 A * 7/1986 Nadler ..... 362/220
5,038,254 A 8/1991 Fabbri et al.
5,086,375 A 2/1992 Fabbri et al.
5,160,193 A 11/1992 Fabbri et al.
5,272,608 A 12/1993 Engle
5,289,357 A 2/1994 Fabbri
5,343,373 A 8/1994 Tillotson
5,727,870 A 3/1998 Grierson
5,921,666 A 7/1999 Preston et al.
6,174,069 B1 1/2001 Plunk et al.
6,247,828 B1 * 6/2001 Herst ..... 362/354
6,402,345 B1 6/2002 Fishman
6,505,953 B1 1/2003 Dahlen
6,776,509 B1 8/2004 Warner
6,793,368 B2 * 9/2004 Ladstatter ..... 362/221
6,837,592 B1 1/2005 Dahlen
2005/0231952 A1 * 10/2005 Garrett et al. ..... 362/260

* cited by examiner

*Primary Examiner*—Hargobind S Sawhney

(57) ABSTRACT

The present invention provides a luminaire comprising a lamp housing having an upper surface and at least one opposed pair of lamp holders extending downwardly from opposing ends of said housing. The housing includes a plurality of apertures in the upper surface thereof to permit transmission of light therethrough and a reversible reflector capable of being secured to said housing in a plurality of positions having a plurality of apertures therein wherein in a first position the apertures in said reflector are aligned with the apertures in said housing to permit light transmission therethrough and wherein in a second position the apertures in said housing are covered by said reflector to prohibit light transmission therethrough.

20 Claims, 12 Drawing Sheets

REVERSIBLE LIGHT REFLECTOR

CROSS-REFERENCE TO RELATED APPLICATIONS

The instant application claims the benefit of and priority to U.S. Provisional Application for Patent Ser. No. 60/805,029 entitled "Reversible Light Reflector", filed on Jun. 16, 2006.

BACKGROUND OF THE INVENTION

1. Field of the Invention

This invention relates to the lighting arts and, more particularly, to a direct-indirect lighting fluorescent luminaire comprising a field-reversible reflector that may be installed to achieve efficient and uniform illumination of a floor and ceiling area, or of just a floor area as necessitated by a specific installation.

2. Description of the Related Art

Fluorescent lighting technology has greatly advanced since its inception in the late 1930s responsive to market requirements for energy efficient lighting systems. Lamp and ballast manufacturers have developed fluorescent lamp-ballast systems with vastly improved energy efficiency that are convenient to use and install. As one example, ANSI T-5 lamps are a type of fluorescent lamp currently used which operate very efficiently at temperatures above ambient room temperature.

Direct-indirect lighting systems are known in the art. Suspended indirect lighting systems are those in which a luminaire containing a lamp or lamps directs light onto a ceiling surface whereby it is reflected downwardly to the area below or simply used to illuminate the area above. These luminaires normally provide a direct or "down" lighting component as well as an indirect or "up" lighting component through the top of the luminaire housing which is either open, has slots disposed in a portion of the luminaire, or includes a light transmitting element such as a lens cover.

Many up light and down light luminaires are designed to produce varying up and down light patterns, depending primarily on the design of a reflector or reflectors disposed proximate the lamps in the luminaire housing. However, this arrangement often requires a purchaser or lighting designer to know exactly what type of lighting is necessary for a given location when ordering or purchasing the fixtures. In many applications, up light is not necessarily required or desirable and as such, a fixture that is configured for up lighting can not be used in a strictly down lighting application.

Fluorescent luminaires utilizing up and down light reflectors have enjoyed widespread acceptance because of their efficiency in converting electrical energy to light energy, their favorable spectral emissions, and their ability to direct light in several directions. However, there have remained problems in their use and manufacture. One disadvantage with existing direct-indirect lighting luminaires is that in many designs, the luminaires are not capable of providing both direct and indirect lighting, or only direct lighting as required by the installation application.

Another disadvantage in the prior art is that luminaires capable of selectively providing both direct-indirect lighting and direct only lighting have complex structures that are not well adapted for field configuration and installation. A proliferation of plates, clips, screws, bolts, nuts and other fasteners is typically required when attempting to convert a direct-indirect type luminaire to a direct only luminaire in the field. These small parts are easily lost, dropped and misplaced and are often difficult to find thereafter.

Additionally, the field installer of these prior art devices requires a great deal of additional labor time, and thus money, to convert from one type of luminaire to another. Furthermore, the complexity of the parts necessary to provide conversion kits for these prior art luminaires makes them more costly than a luminaire that is ordered for a specific application. Accordingly, it is desirable to have a luminaire that is capable of being converted from a direct-indirect lighting type of fixture to a direct only type of fixture with minimal effort and with very few additional parts.

SUMMARY OF THE INVENTION

The present invention generally relates to industrial and commercial lighting fixtures and more particularly to luminaires that provide both direct and indirect lighting, so-called "direct-indirect" luminaires. The invention finds particular application in the field of fluorescent lighting where ambient light is produced from a fluorescent lamp or lamps mounted in an elongated housing having a predetermined length and characteristic cross-sectional shape.

The present invention includes a luminaire having an industrial up light reflector, and, more particularly, to a luminaire housing a fluorescent lamp, for example an ANSI T-5 lamp or the like, where the housing includes a plurality of slots or apertures in a down light reflector and a corresponding plurality of slots or apertures in the body portion of the luminaire. This luminaire efficiently provides direct down lighting and uniform indirect up lighting when appropriately configured.

Uses of the instant invention include but are not limited to retail stores, such as grocery, drug, and department stores, where the fixtures are commonly mounted in continuous rows. The fixtures may also be used in warehouses, factories or other industrial and commercial settings where direct-indirect lighting may be required.

The direct/indirect fluorescent lighting system of the instant invention permits and installer to customize a luminaire to provide direct light only or indirect and direct light simultaneously. In one embodiment of the present invention, the luminaire is selectively configurable such that a first portion of the luminaire may supply direct and indirect light while a second portion thereof may supply only direct illumination.

The luminaire disclosed herein provides direct down lighting as well as selectable indirect up lighting by utilizing a plurality of reversible light reflectors having a reflective surface and a plurality of slots or apertures therein that may be positioned to either align with or block complementary slots in the luminaire housing. This reflective surface may be convex, divergent, concave, flat, or even have an irregular shape as required. Each reflector may be sized to correspond to a given lamp region or a plurality of lamp regions within a single luminaire housing so that individual lamps or lamp sets may provide direct or indirect illumination depending upon the corresponding reflector configuration.

The instant invention has a structural design that permits a configurable direct-indirect illumination type luminaire to be manufactured and assembled with very few parts as well as be easily and quickly configured in the field.

The instant invention accomplishes these objectives by providing a direct-indirect luminaire comprised of a pair of opposing lamp holders, a plurality of reversible light reflectors including a plurality of slots and a housing having complementary slots.

Other features and advantages of the invention will become apparent from the detailed description of the preferred embodiments herein below, taken in conjunction with the accompanying drawing Figures.

BRIEF DESCRIPTION OF THE DRAWING FIGURES

DETAILED DESCRIPTION OF THE PREFERRED EMBODIMENT(S)

Figure 1A:
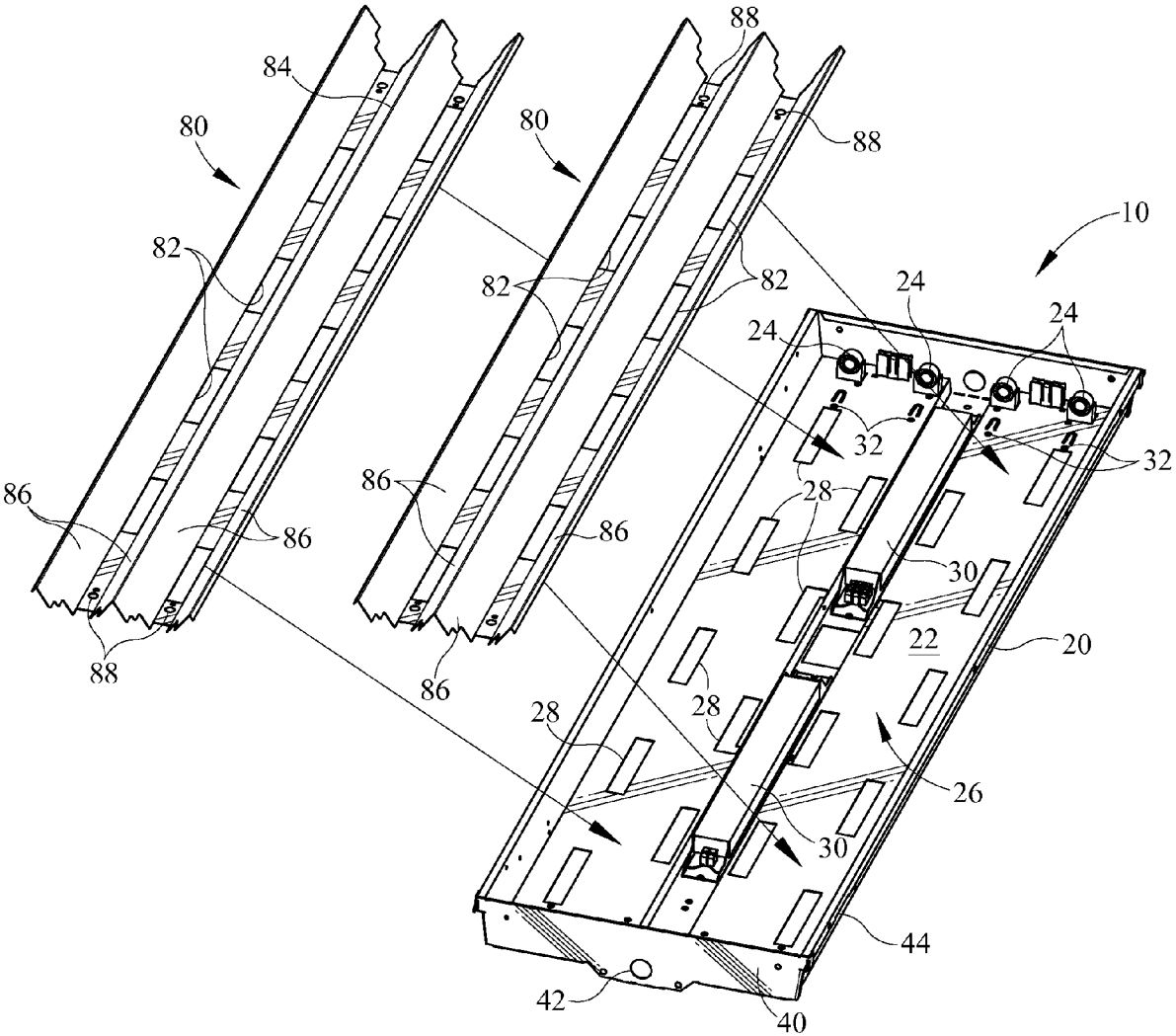
FIG. 1A is an exploded perspective view of a luminaire assembly in accordance with one embodiment of the present invention.
Figure 1B:
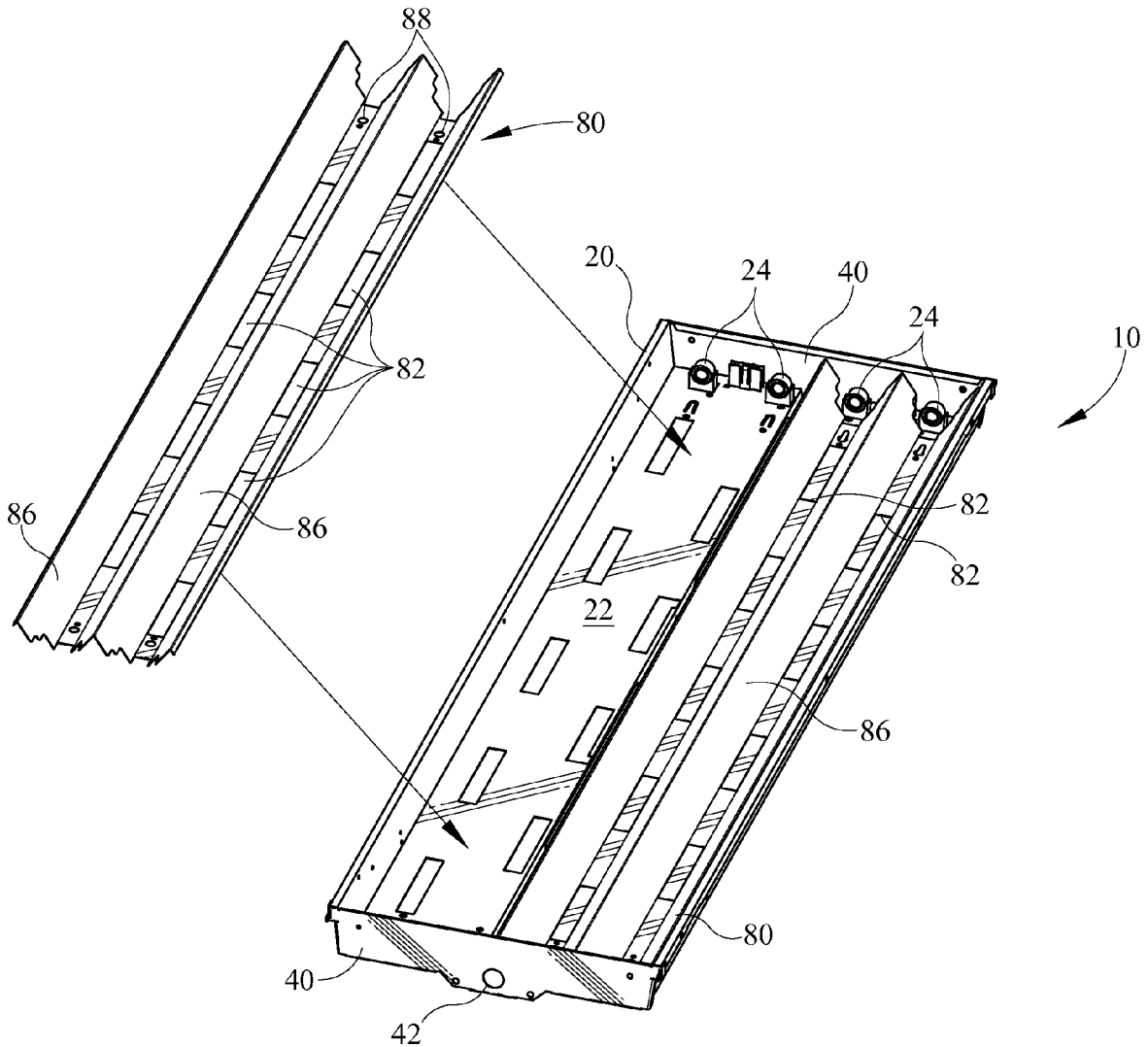
FIG. 1B is an exploded perspective view of a luminaire assembly having one reversible reflector installed in an up-light configuration in accordance with one embodiment of the present invention.
Figure 1C:
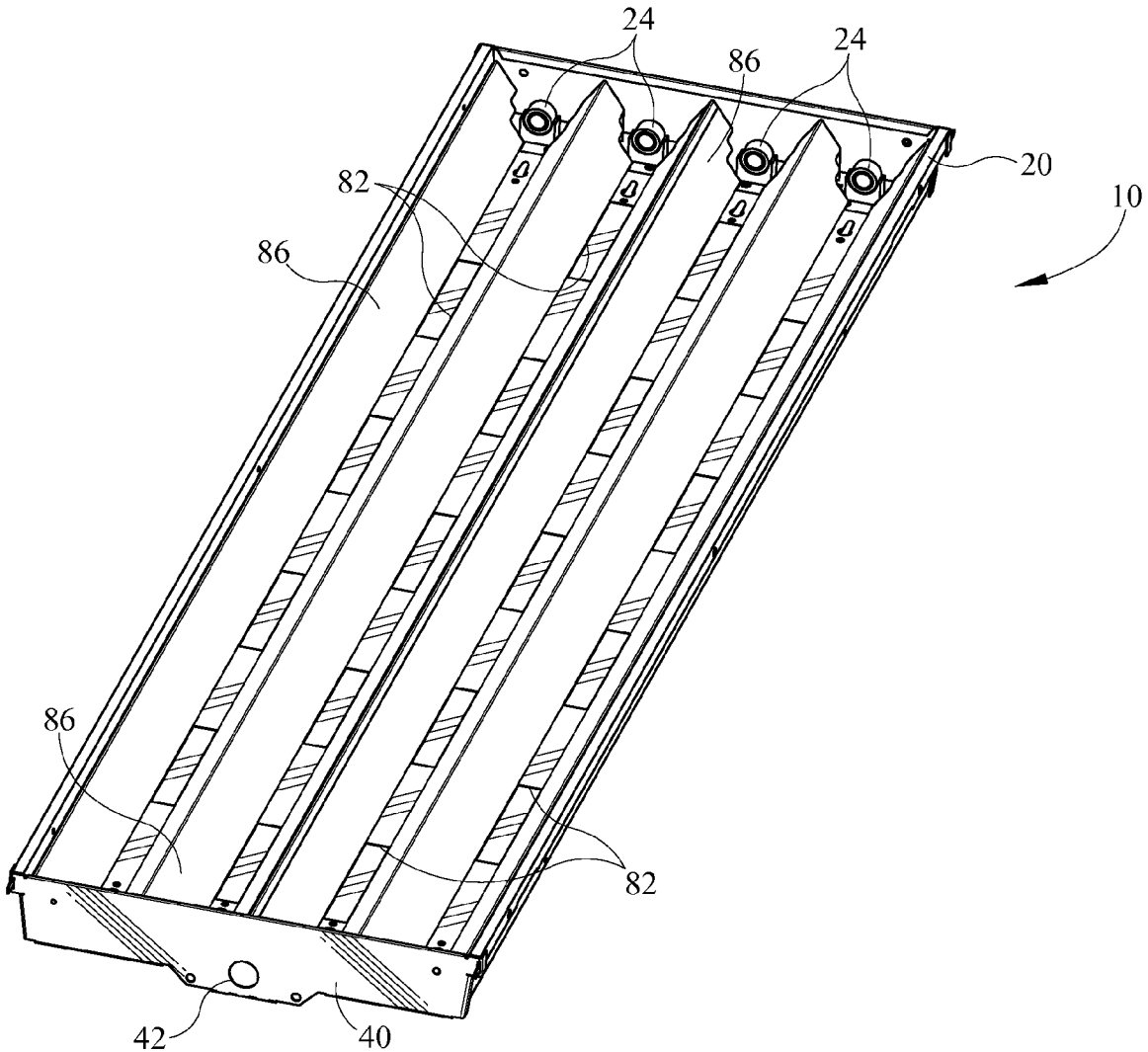
FIG. 1C is an exploded perspective view of a luminaire assembly having two reversible reflectors installed in an up-light configuration in accordance with one embodiment of the present invention.

Referring now to FIG. 1A-C, and in accordance with a preferred embodiment of the present invention, a luminaire 10 comprises a housing 20 having a housing top surface 22 that is depicted in the drawing Figures as a generally rectangular planar surface. Note that FIGS. 1A-C are exploded downward perspective views of luminaire 10 such that the underside of luminaire housing 20 is shown. Top surface 22 may be formed in a variety of shapes depending upon the overall shape of housing 20 and the aesthetic requirements of the luminaire. Housing 20 is preferably formed from an aluminum alloy sheet or the like, to provide a lightweight and inexpensive luminaire 10.

Housing 20 further comprises a plurality of pairs of lamp holders 24, spaced apart one from other a distance sufficient to accommodate a fluorescent lamp. Luminaire 10 and lamp holders 24 may be sized and spaced in a wide variety of configurations to accommodate the use of a plurality of different lamp sizes as necessitated by the overall housing 20 shape, which is not limited to the generally rectangular configuration shown in the drawing Figures.

Housing 20 may further include a wire way 30 through which electrical wiring is routed and inside of which electrical ballasts required to start fluorescent lamps may be mounted. In the luminaires 10 shown in the drawing Figures wire ways 30 are shown as generally situated longitudinally between two pairs of lamp holders 24. This central location facilitates the ease of manufacture of luminaire 10 as well as ease of connecting power wiring thereto in the field.

Figure 3:
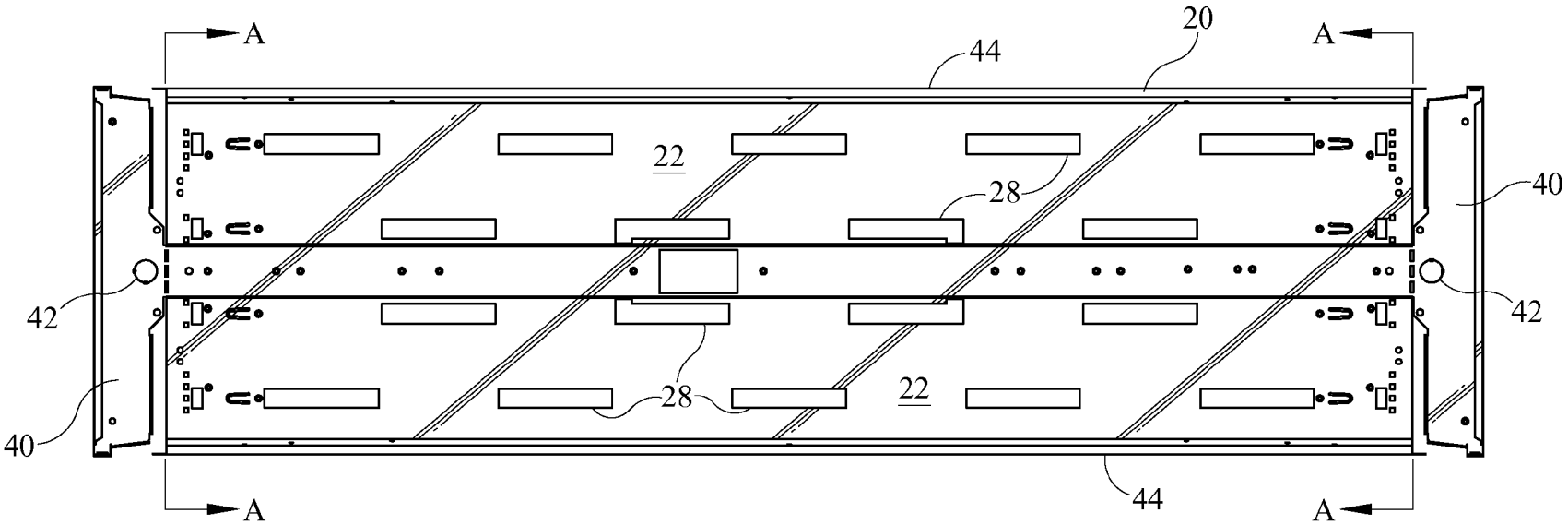
FIG. 3 is a plan view of a luminaire housing in accordance with one embodiment of the present invention.
Figure 4:
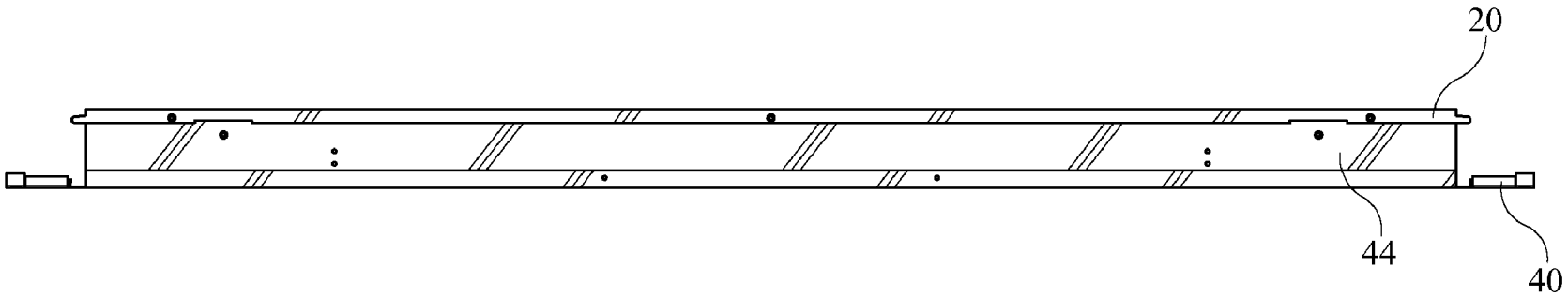
FIG. 4 is an elevation view of a luminaire housing in accordance with one embodiment of the present invention.
Figure 5:
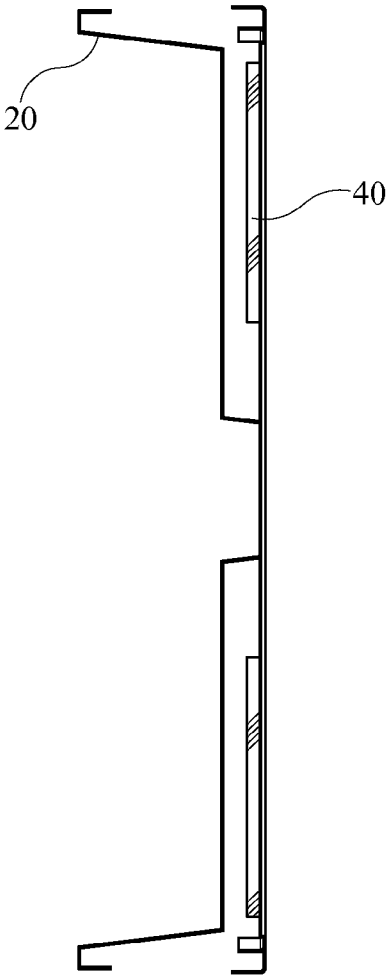
FIG. 5 is a perspective view of an unassembled luminaire housing in accordance with one embodiment of the present invention.

As best seen in FIG. 3, which is a plan view of an unassembled housing 20, the housing 20 further comprises an opposed pair of end caps 40 each having an aperture 42 therein through which power wiring may be routed. End caps 40 are constructed integrally with the housing 20 top surface 22 thence bent or folded upwardly along the lines A_A to mate with a pair of housing 20 sides 44 to form completed housing 20. The aforementioned housing 20 construction permits the manufacture of housing 20 from a single piece of material, for example a coated aluminum alloy, that is readily cut, drilled or stamped, and bent to its final shape by modern manufacturing methods.

Referring again to FIGS. 1A-1C opposed lamp holder pairs 24 each define a lamp region 26 generally understood to be the area proximate the installed lamp on the upper surface 22. Lamp regions 26 are generally shown as elongated portions of upper surface 22, but may be regions having different shapes depending upon the shape of the lamps used and luminaire design. As an example, a luminaire housing 20 may comprise a lamp region 26 that is circular, thereby permitting use of circular or curved lamps.

Upper surface 22 further includes a plurality of apertures 28, shown in exemplary form in the drawing Figures as slots having a generally rectangular shape. As best seen in FIGS. 1A-C and 2A-C a plurality of slots 28 are disposed in upper surface 22 proximate lamp regions 26 such that light from an installed lamp may be directed therethrough to illuminate an area above the installed luminaire.

Figure 6:
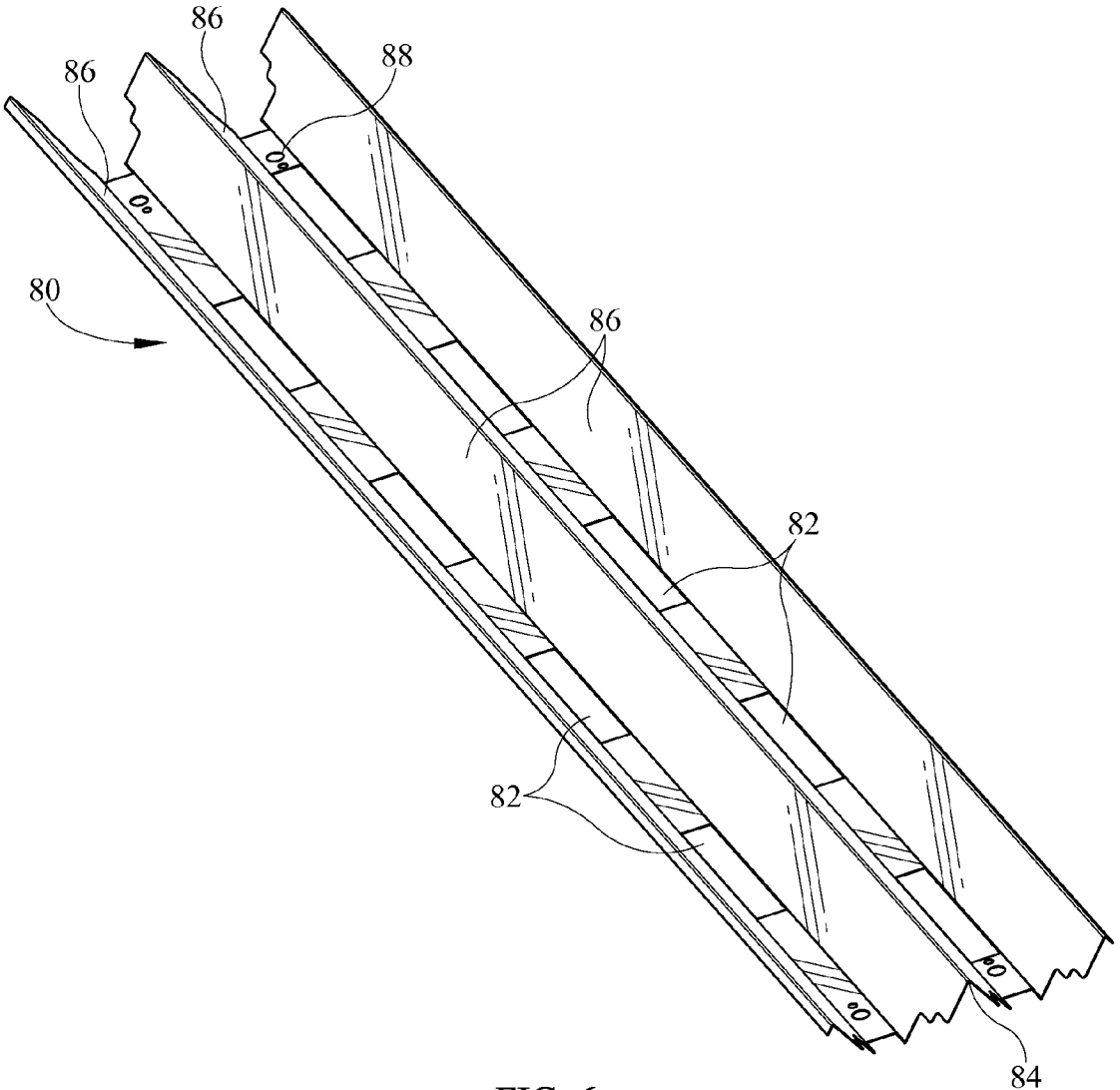
FIG. 6 is a perspective view of a reversible reflector in accordance with one embodiment of the present invention.
Figure 7:
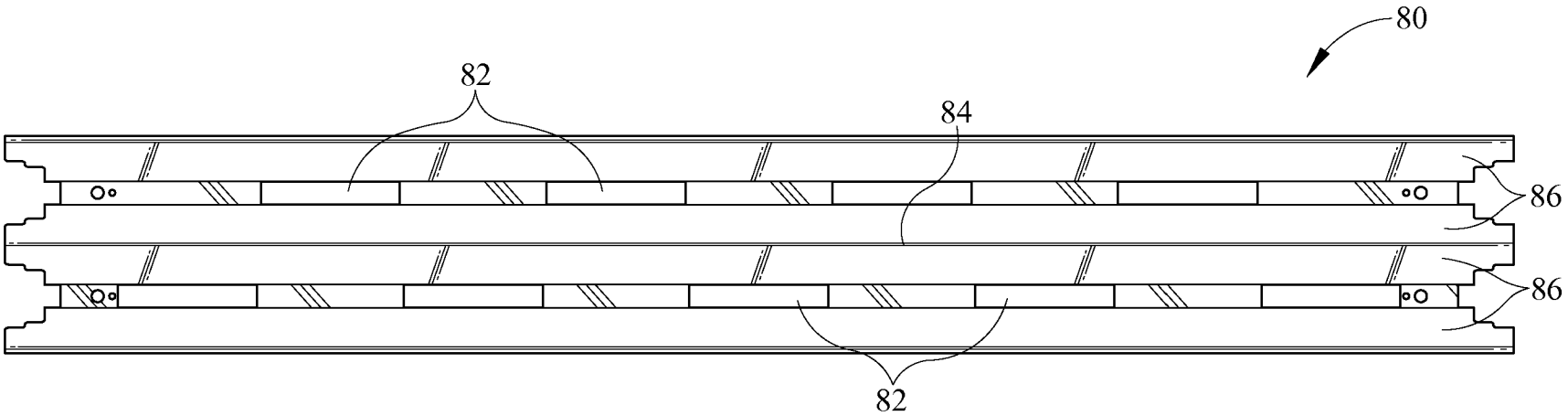
FIG. 7 is a plan view of a reversible reflector in accordance with one embodiment of the present invention.
Figure 8:
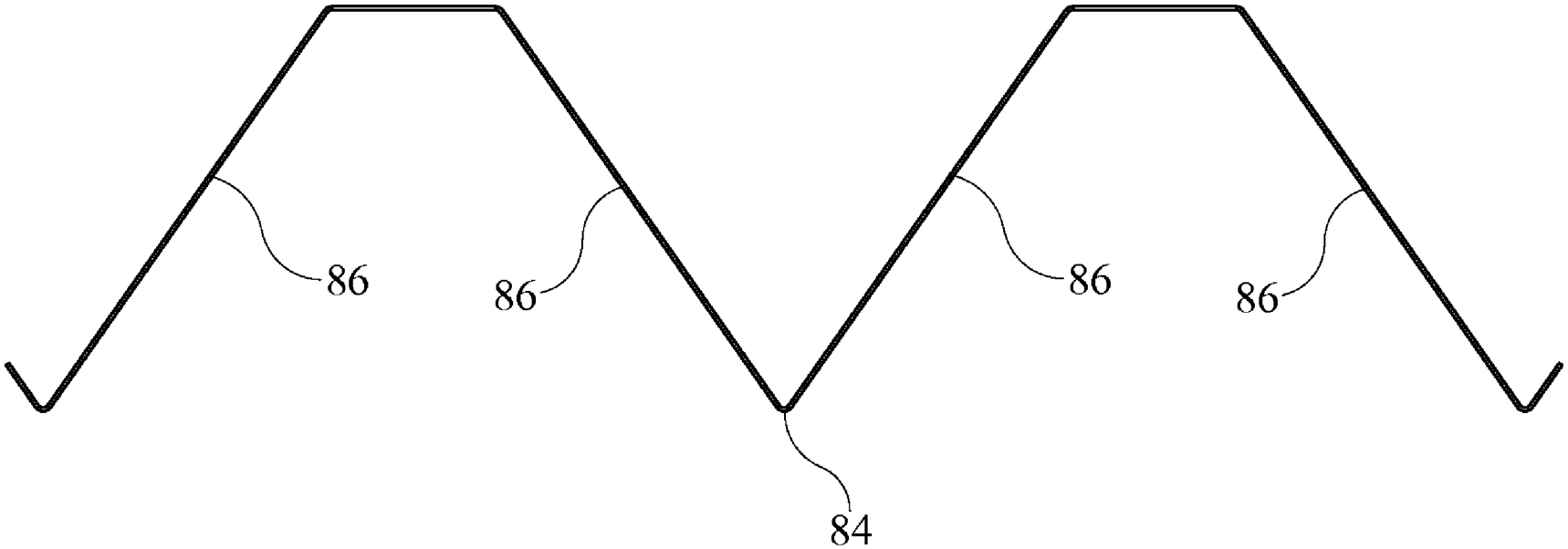
FIG. 8 is an end view of a reversible reflector in accordance with one embodiment of the present invention.

The luminaire 10 of the present invention further comprises a plurality of reversible reflectors 80 each having a plurality of apertures 82 or slots therein. In one embodiment of the invention as best seen in FIGS. 6, 7 and 8 each reflector may include a central longitudinal divider 84 that separates adjacent lamps and provides angled reflective surfaces 86 for directing light downwardly to a lighting area below luminaire 10.

In this embodiment of the invention each reversible reflector 80 is secured to housing 20 and accommodates a pair of adjacent lamps installed in adjacent pairs of lamp holders 24. However, it should be understood that reversible reflector 80 may be configured to accommodate a single lamp, or a plurality thereof without departing from the scope of the present invention. Referring again to FIGS. 1A-C a pair of reversible reflectors 80 are provided with apertures 82 that are complementary to the apertures 28 provided in housing 20. Reflectors 80 may further have a plurality of screw apertures 88 that align closely with complementary screw apertures 32 in housing 20 when reflector 80 is placed into housing 20 for securing reflector 80 to housing 20 with a removable fastener such as a screw (now shown).

FIG. 1A depicts a pair of reversible reflectors 80 each of which includes two groups of apertures 82 proximate reflective surfaces 86. The reflectors 80 are oriented such that the apertures 82 do not align with the apertures 28 proximate each lamp region 26 when reflectors 80 are installed as shown in FIGS. 1B and 1C. In this particular exemplary embodiment of the invention the apertures 28 proximate the lamp regions 26 in the interior of housing 20 include four (4) rectangular apertures 28 while the apertures proximate the exterior lamp regions 26 include five (5) rectangular apertures 28. When reflectors 80 are installed in housing 20 as shown in FIGS. 1B and 1C the reflector 80 apertures 82 do not align with apertures 28 thereby prohibiting light transmission through housing 20 once lamps are properly installed.

Figure 2A:
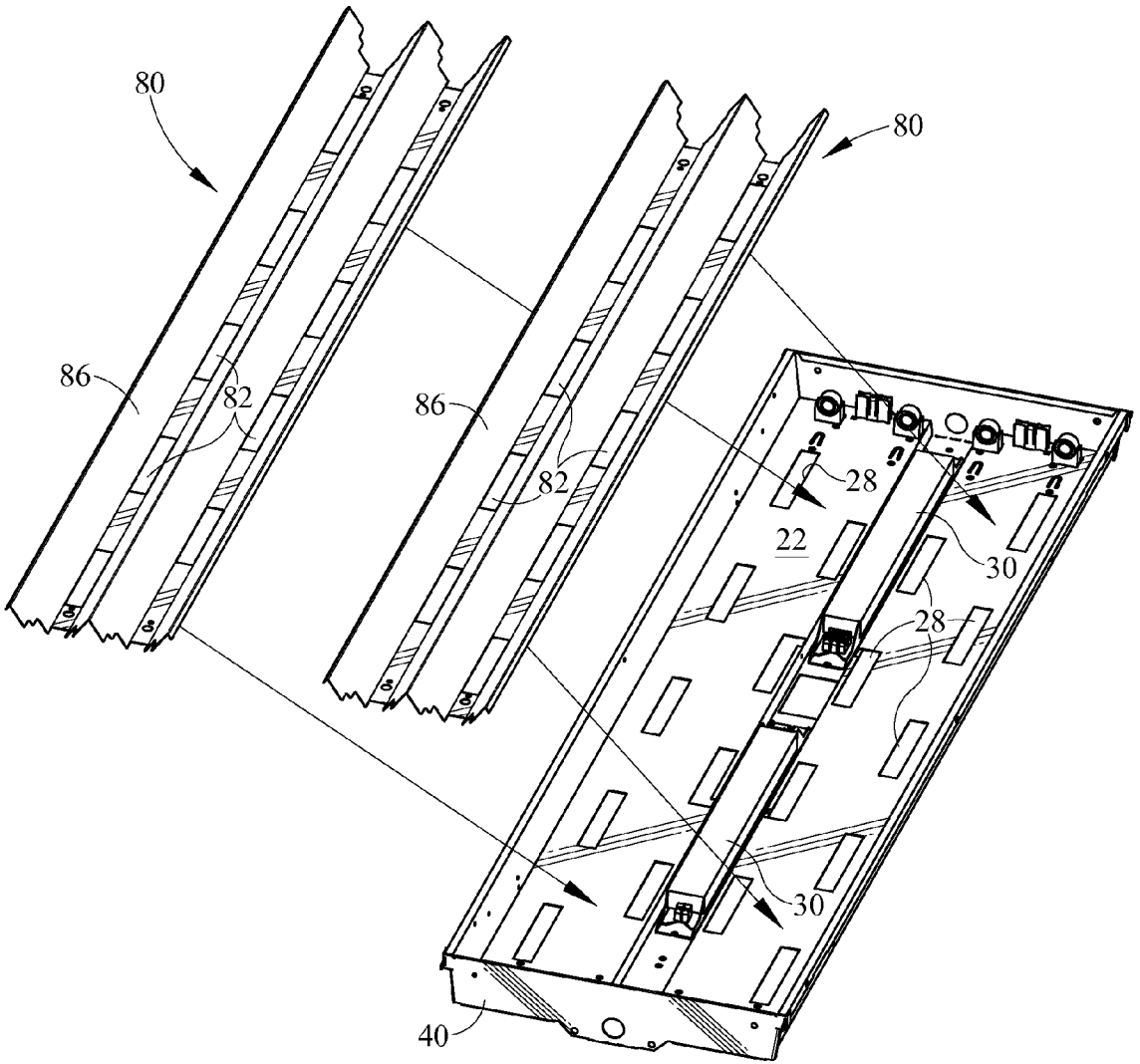
FIG. 2A is an exploded perspective view of a luminaire assembly in accordance with one embodiment of the present invention.
Figure 2B:
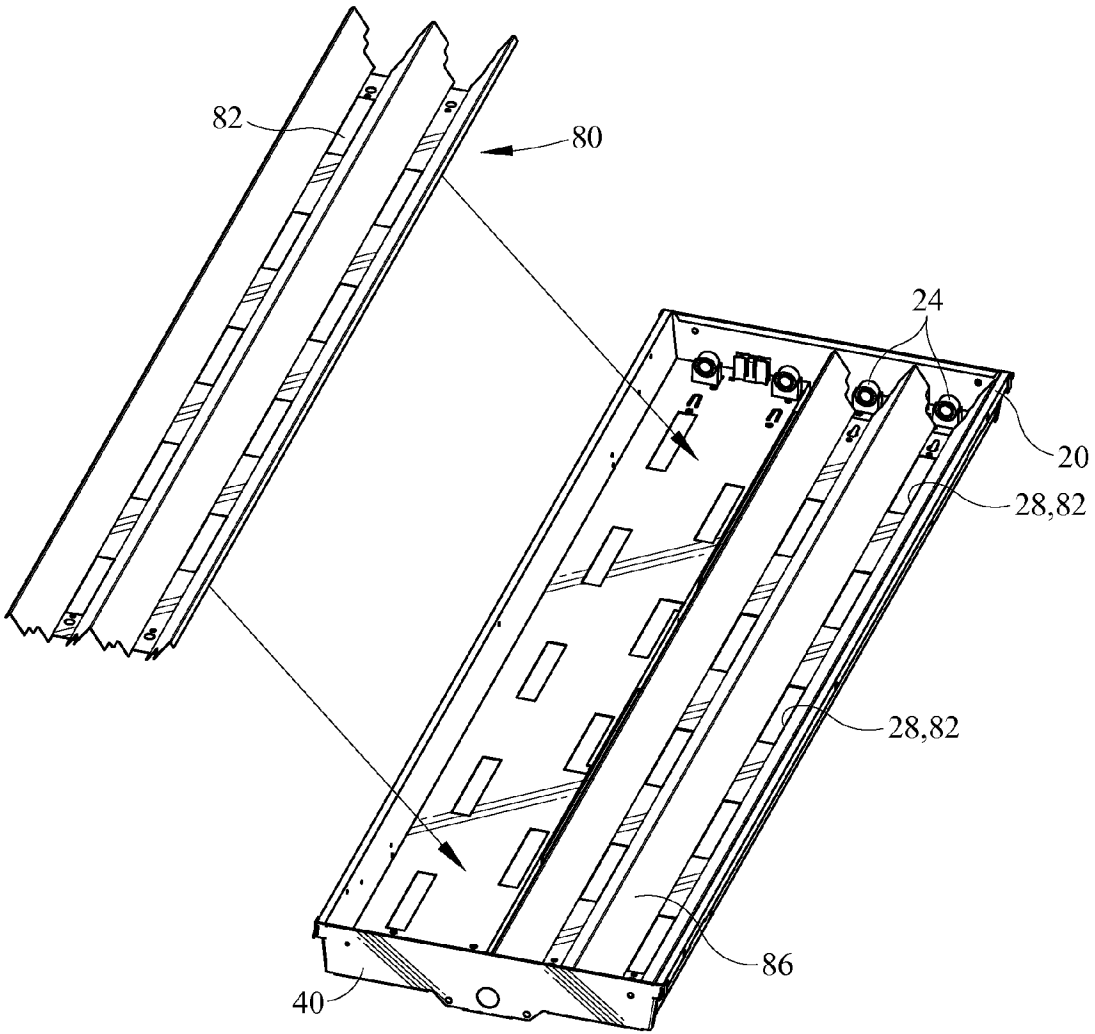
FIG. 2B is an exploded perspective view of a luminaire assembly having one reversible reflector installed in a no up-light configuration in accordance with one embodiment of the present invention.
Figure 2C:
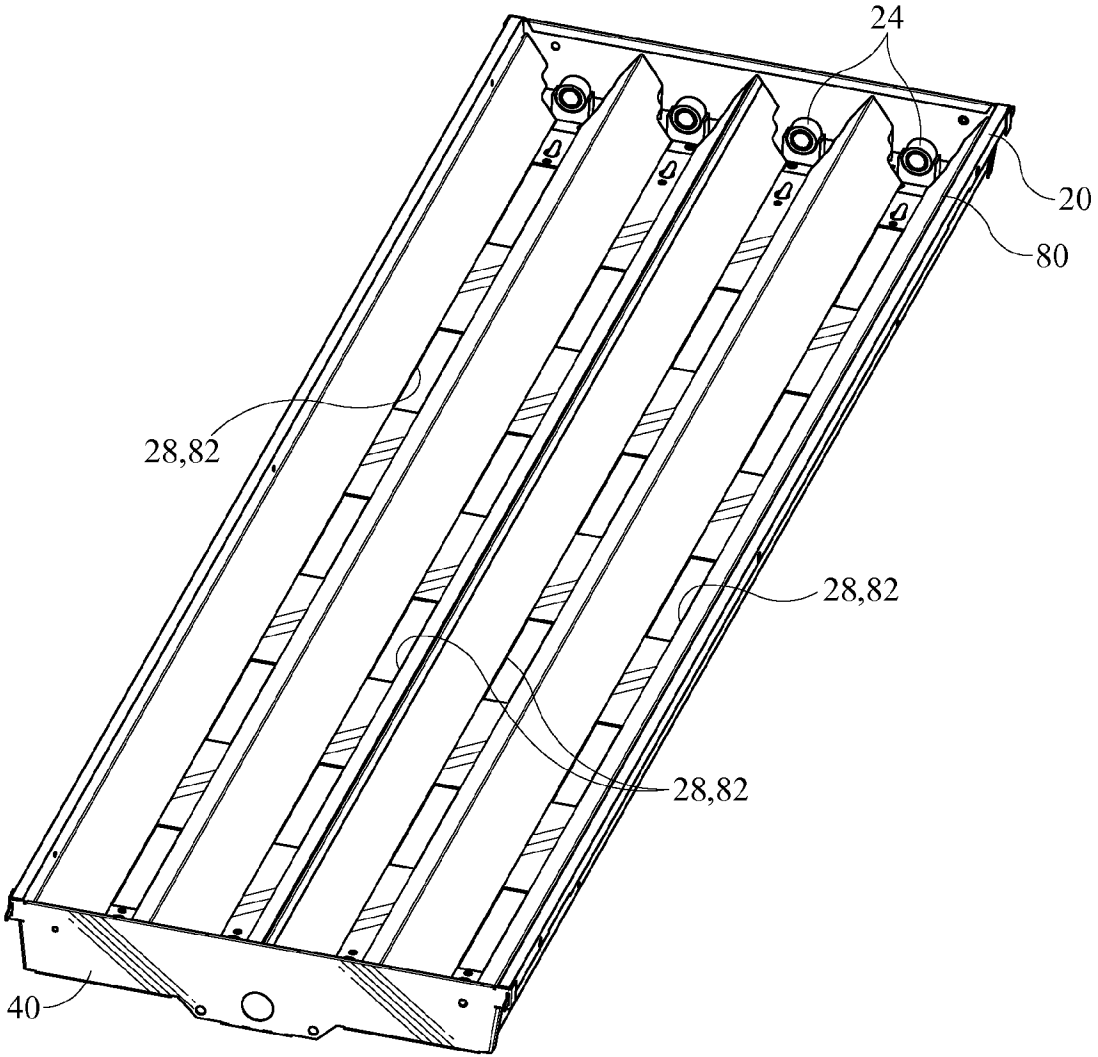
FIG. 2C is an exploded perspective view of a luminaire assembly having two reversible reflectors installed in a no up-light configuration in accordance with one embodiment of the present invention.

Referring now to FIGS. 2A-C there is shown generally a housing 20 identical to that of FIGS. 1A-C and a pair of reversible reflectors 80 that are identical to those of FIGS. 1A-C but whose orientation is reversed such that the four aperture 82 groups of reflectors 80 are now aligned with the interior lamp regions 26 while the five aperture groups 82 of reflectors 80 are aligned with the exterior lamp regions 26 of housing 20. In this orientation, when installed in housing 20 apertures 82 align closely with apertures 28 in housing 20 thereby permitting up lighting once lamps are installed. Thus the reflectors 80 may be readily reversed to provide for up-light or no up-light as desired by an installer.

As can be readily seen from the description herein above luminaries 10 in accordance with the instant invention may be quickly and easily configured to provide up light and down light, or down light only, simply depending upon the orientation of reflectors 80 as they are installed in housing 20. In a yet further embodiment of the invention a single luminaire 10 may be configured to provide up light and down light from a pair of lamps while providing only down light from an adjacent pair of lamps by simply installing a pair of reflectors 80 in opposite orientations.

FIGS. 6, 7, and 8 depict an exemplary reflector 80 configured to accommodate a pair of lamps. Reflector 80 may further include reflective surfaces 86 to direct light downwardly and may be formed of a reflective metal or a material having a reflective coating thereon to enhance luminaire 10 efficiency. Furthermore, reflective surfaces 86 may be convex, concave, flat, or include more complex shapes as desired to direct light downwardly to a subject or subjects.

The reflectors 80 shown in the drawing Figures have a four aperture 82/five aperture 82 configuration for use in adjacent four aperture 28/five aperture lamp regions 26. However, one of ordinary skill in the art will understand that a wide variety of aperture shapes and locations in both reflector 80 and housing 20 may be used as long as reflector 80 apertures 82 generally align with housing apertures 28 in a first reflector 80 orientation and generally block or cover housing apertures 28 in a second reflector 80 orientation.

As one example, a plurality of generally circular apertures 82 may be provided on each reflector 80 to align with generally circular apertures 28 disposed proximate each lamp region of housing 20. The plurality of circular apertures 82 may be arranged on reflector 80 so that they align with the circular apertures 28 of housing 20 when the reflector 80 is in a first orientation, but block apertures 28 when reflector 80 is in a second orientation. In this fashion, the apertures 28 and 82 may be shaped in a wide variety of different shapes, and be spaced in a plurality of patterns in both housing 20 and reflectors 80 to establish specific up light illumination patterns which may be desirable in lighting installations.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

We claim:

1. A luminaire comprising:

a lamp housing having an upper surface defining a lamp region, said housing having a plurality of apertures in the upper surface thereof to permit transmission of light therethrough;

a reversible reflector having a plurality of apertures therein, said reflector capable of being secured to said housing in a plurality of orientations including a first orientation and a second orientation;

wherein in said first orientation the apertures in said reflector are aligned with the apertures in said housing to permit light transmission therethrough; and wherein in said second orientation the apertures in said housing are covered by said reflector to prohibit light transmission therethrough; and a plurality of reflective surfaces on said reversible reflector for directing light downwardly from said luminaire, said reflective surfaces forming an elongated channel extending substantially the entire length of said housing on either side of said plurality of apertures and substantially surrounding an elongated lamp to direct light downwardly away from said upper surface of said housing.

2. A luminaire as claimed in claim 1 further comprising:

a plurality of reversible reflectors capable of being secured to said housing.

3. A luminaire as claimed in claim 1 further comprising;

a plurality of opposed pairs of lamp holders secured to said housing, the area between said pairs of lamp holders defining a plurality of lamp regions and;

a plurality of reversible reflectors having apertures therein that are complementary to a plurality of apertures in said housing.

4. A luminaire as claimed in claim 1 wherein said reversible reflector further comprises:

a divider for separating adjacent lamps.

5. A luminaire as claimed in claim 1 wherein said housing further comprises:

a pair of opposed end caps.

6. A luminaire as claimed in claim 1 wherein said housing is elongated to accommodate a plurality of elongated fluorescent lamps.

7. A luminaire comprising:

a lamp housing having an upper surface defining a lamp region, said housing having a plurality of apertures in the upper surface thereof to permit transmission of light therethrough;

a reversible reflector having a plurality of apertures therein, said reflector capable of being secured to said housing in a plurality of orientations;

wherein in a first orientation the apertures in said reflector are aligned with the apertures in said housing to permit light transmission therethrough; and wherein in a second orientation the apertures in said housing are covered by said reflector to prohibit light transmission therethrough; and wherein reflective surfaces on said reversible reflector are elongated convex surfaces that extend substantially the entire length of said housing.

8. A luminaire comprising:

an elongated housing having an upper surface, a pair of integral end caps and a plurality of elongated lamp regions therebetween for placement of a plurality of lamps, wherein the upper surface includes a plurality of slots therein for transmission of light above said luminaire;

a plurality of reversible reflectors capable of being secured to said housing in a first and a second orientation and having a plurality of slots therein;

wherein the plurality of slots in said reflector are generally aligned with a portion of the plurality of slots in said housing when said reflector is in the first orientation; and said plurality of reversible reflectors corresponding to the plurality of lamp regions;

each of said plurality of reversible reflectors having a pair of reflective surfaces for directing light downwardly from said lamp regions;

wherein said reflective surfaces are convex.

9. A luminaire comprising:

an elongated housing having an upper surface, a pair of integral end caps and a plurality of elongated lamp regions therebetween for placement of a plurality of lamps, wherein the upper surface includes a plurality of slots therein for transmission of light above said luminaire;

a plurality of reversible reflectors capable of being secured to said housing in a first and a second orientation and having a plurality of slots therein; and wherein the plurality of slots in said reflector are generally aligned with a portion of the plurality of slots in said housing when said reflector is in the first orientation; and said plurality of reversible reflectors corresponding to the plurality of lamp regions; and each of said plurality of reversible reflectors having a pair of reflective surfaces for directing light downwardly from said lamp regions;

wherein said reflective surfaces are concave.

10. A luminaire comprising:

an elongated housing having an upper surface, a pair of integral end caps and a plurality of elongated lamp regions therebetween for placement of a plurality of lamps, wherein the upper surface includes a plurality of slots therein for transmission of light above said luminaire;

a plurality of reversible reflectors capable of being secured to said housing in a first and a second orientation and having a plurality of slots therein;

wherein the plurality of slots in said reflector are generally aligned with a portion of the plurality of slots in said housing when said reflector is in the first orientation; and said plurality of reversible reflectors corresponding to the plurality of lamp regions; and each of said plurality of reversible reflectors having a pair of reflective surfaces for directing light downwardly from said lamp regions;

wherein each said reflectors further comprise:

a central longitudinal portion separating the pair of reflective surfaces.

11. A luminaire comprising:

an elongated housing having an upper surface, a pair of integral end caps and a plurality of elongated lamp regions therebetween for placement of a plurality of lamps, wherein the upper surface includes a plurality of slots therein for transmission of light above said luminaire;

a reversible reflector capable of being secured to said housing in a first and a second orientation and having a plurality of slots therein; and wherein the plurality of slots in said reflector are generally aligned with a portion of the plurality of slots in said housing when said reflector is in the first orientation; and wherein said reversible reflector further comprises:

a plurality of pairs of reflective surfaces for directing light downwardly from said lamp regions, the pairs of reflective surfaces separated by a central longitudinal divider for separating lamp regions one from another.

12. A luminaire comprising:

a housing having an upper surface with a plurality of apertures therein and at least one lamp holder secured thereto for electrically connecting a lamp thereto;

a reflector secured to said housing in a first position, said reflector having a plurality of apertures therein that generally align with the apertures in said housing to provide for light transmission therethrough; and wherein said reflector may be secured to said housing in at least one other position so that the apertures therein do not align with the apertures in said housing to block light transmission therethrough; and wherein said reflector further has a plurality of reflective surfaces for reflecting light from a lamp downwardly when said luminaire is suspended overhead;

said reflective surfaces forming an elongated channel extending substantially the entire length of said housing on either side of said plurality of apertures and substantially surrounding in a substantially concave or convex shape an elongated lamp to direct light downwardly away from said upper surface of said housing.

13. A luminaire as claimed in claim 12 comprising:

a plurality of reflectors.

14. A luminaire as claimed in claim 12 wherein said housing comprises a unitary member having a pair of end caps integral thereto.

15. A luminaire as claimed in claim 14 wherein the at least one lampholder is secured to the end caps of said housing.

16. A luminaire as claimed in claim 12 wherein the plurality of apertures in said reflector are generally rectangular in shape, and wherein the plurality of apertures in said housing are generally rectangular in shape.

17. A luminaire as claimed in claim 12 wherein said housing is shaped to accommodate a curved lamp.

18. A luminaire as claimed in claim 17 wherein said reflector is shaped to accommodate a curved lamp.

19. A luminaire as claimed in claim 12 wherein said housing is shaped to accommodate a longitudinally extending incandescent lamp.

20. A luminaire as claimed in claim 19 wherein said reflector is shaped to accommodate a longitudinally extending incandescent lamp.

* * * * *